US007391162B2

(12) United States Patent
Rohlfing et al.

(10) Patent No.: US 7,391,162 B2
(45) Date of Patent: Jun. 24, 2008

(54) LUMINAIRE WITH LED(S) AND METHOD FOR OPERATING THE LUMINAIRE

(75) Inventors: Ralph Rohlfing, Weyhe (DE); Wolfgang Serfass, Bremen (DE)

(73) Assignee: Aqua Signal Aktiengesellschaft, Bremen (DE)

( * ) Notice: Subject to any disclaimer, the term of this patent is extended or adjusted under 35 U.S.C. 154(b) by 274 days.

(21) Appl. No.: 11/104,261

(22) Filed: Apr. 12, 2005

(65) Prior Publication Data

US 2007/0001870 A1 Jan. 4, 2007

(51) Int. Cl.
*H05B 37/02* (2006.01)

(52) U.S. Cl. ..... 315/150; 315/308

(58) Field of Classification Search ..... 315/149, 315/150, 157, 158, 291, 307, 308; 362/555, 362/582, 257, 326, 317, 341
See application file for complete search history.

(56) References Cited

U.S. PATENT DOCUMENTS

| | | | | |
|---|---|---|---|---|
| 4,182,977 | A | 1/1980 | Stricklin, Jr. | |
| 5,783,909 | A * | 7/1998 | Hochstein | 315/159 |
| 6,078,148 | A | 6/2000 | Arts et al. | |
| 6,236,331 | B1 | 5/2001 | Dussureault | |
| 6,285,139 | B1 * | 9/2001 | Ghanem | 315/291 |
| 6,305,818 | B1 * | 10/2001 | Lebens et al. | 362/184 |
| 6,441,750 | B1 | 8/2002 | Hutchinson | |
| 6,507,159 | B2 * | 1/2003 | Muthu | 315/307 |
| 6,510,995 | B2 * | 1/2003 | Muthu et al. | 235/454 |
| 6,630,801 | B2 * | 10/2003 | Schuurmans | 315/307 |
| 6,870,325 | B2 * | 3/2005 | Bushell et al. | 315/224 |
| 7,173,383 | B2 * | 2/2007 | Vornsand et al. | 315/291 |
| 2002/0140379 | A1 * | 10/2002 | Chevalier et al. | 315/291 |
| 2007/0132398 | A1 * | 6/2007 | Ferguson et al. | 315/159 |

FOREIGN PATENT DOCUMENTS

| | | |
|---|---|---|
| DE | 101 40 531 A1 | 2/2003 |
| DE | 102 01 908 C1 | 7/2003 |
| EP | 0 935 145 A1 | 8/1999 |
| EP | 1 215 641 A2 | 6/2002 |
| EP | 0 979 597 B1 | 7/2002 |
| EP | 1470999 | 4/2004 |

OTHER PUBLICATIONS

DE Search Report, 10 2005 016 363.7, Bremen, Germany.

* cited by examiner

*Primary Examiner*—Thuy Vinh Tran
(74) *Attorney, Agent, or Firm*—Laurence P. Colton; Smith, Gambrell & Russell

(57) ABSTRACT

The invention relates to a luminaire with at least one LED and a method for operating the luminaire. The luminaire has a sensor for detecting at least a part of the light emitted by the LED and also a control unit for evaluating the sensor signals and for influencing the LED in a manner dependent on the sensor signals. After the luminaire has been switched on, a specific LED current flows and the light intensity of the LED is checked. In the case of a light intensity below a reference value, the LED current is raised by a defined value.

16 Claims, 13 Drawing Sheets

LUMINAIRE WITH LED(S) AND METHOD FOR OPERATING THE LUMINAIRE

BACKGROUND OF THE INVENTION

1. Technical Field

The invention relates to a luminaire with at least one LED as luminous means and a method for operating the luminaire.

2. Prior Art

The light intensity of luminaires with LEDs is subject to fluctuations depending on the age and on the temperature of the LEDs. The ageing process has a particularly serious effect. A reduction of the light intensity to just 50% or less is possible. The light intensity changes only slowly and the alteration can hardly be perceived from the vicinity of operators.

A reduction of the light intensity is particularly critical in connection with applications for which specific luminous ranges are legally prescribed. A main area of application of the invention is navigation luminaires on ships. Luminaires of this type are also referred to as position lanterns and must have a luminous range of two nautical miles in the USA, for example. Other countries have in part different regulations.

When the light intensity of the LED decreases, the actual luminous range may fall below the legally prescribed value, so that the envisaged function is no longer fulfilled. Even without the presence of legal provisions, maintaining a specific light intensity for a luminaire is advantageous and desirable, for instance for illuminating traffic areas or properties or in connection with other types of signal and position luminaires.

BRIEF SUMMARY OF THE INVENTION

It is an object of the present invention to provide a luminaire which enables a minimum light intensity to be complied with. In particular, the intention is to comply with a defined or even Constant light intensity.

The luminaire according to the invention is characterized by the following features:

a) a sensor for detecting at least a part of the light emitted by the LED, b) a control unit for evaluating the sensor signals and for influencing the LED in a manner dependent on the sensor signals.

In the simplest case, the control unit switches off the LED after a limit value of the light intensity has been undershot. The luminaire or LED can then be identified as defective and can be exchanged. Preferably, precisely one LED is provided as luminous means.

According to a further concept of the invention, it is provided that the control unit regulates the electric current of the LED (LED current) in a manner dependent on the sensor signals such that the light intensity of the LED remains above a reference value. After the luminaire has been switched on, the light intensity of the LED is detected by means of the sensor and adapted by regulating the LED current until a desired value is reached.

According to a further concept of the invention, a reference value for a desired light intensity of the LED is defined by the control unit as follows:

a) after the luminaire has been switched on for the first time, a desired value of the light intensity is determined as reference value in a manner dependent on the sensor signals then present.

b) the reference value is stored by the control unit.

The luminaire is switched on for the first time preferably in the absence of ambient light in order that the sensor exclusively receives light from the LED.

In an advantageous manner, the control unit prescribes a defined LED current when the luminaire is switched on for the first time. Said current can be stored in the control unit and is adapted to the structural and electrical data of the LED. The aim is a light intensity that suffices for the envisaged luminous range at the beginning of the service life of the LED. An increase in the LED current is intended to be necessary only with incipient ageing.

According to a further concept of the invention, the control unit permanently or cyclically compares the sensor signals with the reference value. In the event of the reference value being undershot, the control unit raises the LED current by a defined step from a present current value to a new current value. The new current value is then stored as present current value.

In an advantageous manner, when the luminaire is switched on again, the control unit prescribes the present current value that was stored last as LED current.

According to a further concept of the invention, the control unit raises the current value only up to a defined maximum value. It is thereby possible to avoid damage due to an excess of electrical power, for instance excessively great heating.

In an advantageous manner, the control unit concomitantly counts the operating hours of the LED after the current value has reached the maximum value.

The operating hours incurred after the maximum value has been reached are stored. Preferably, the control unit no longer switches on the LED if a defined number of operating hours has been reached. The defined number of operating hours is referred to as waiting time. Only after the waiting time has elapsed is it assumed that the luminaire no longer fulfills the intended purpose of use. The luminaire is then defined as defective. However, the luminaire is preferably not switched off during operation in progress. The control unit only prevents the luminaire from being switched on again as soon as the waiting time has been exhausted. This is particularly important and expedient for applications in which the luminaire is regularly switched on from time to time and, at the same time, an automatic switch-off during operation might have fatal consequences. Thus, by way of example, navigation luminaires on ships are not permitted to be automatically switched off suddenly at night.

An LED switch-off effected by the control unit means that a later attempt to switch on the luminaire does not lead to the LED lighting up.

According to a further concept of the invention, a light deflection device for the concentration or at least deflection of the light emitted by the LED is provided, at least a part of the light being deflected in the direction of the sensor by the light deflection device. The light deflection device may be a lens, a prism or a mirror, or else a combination thereof, e.g. a lens with partly mirroring or prismatic areas. A navigation luminaire with LED and essentially prismatic light deflection device is described in our European Patent Application EP 1 470 999 A2. Reference is expressly made to the disclosure of this application.

In an advantageous manner, the light deflection device deflects the light such that one part of the light is emitted by the luminaire and another part, in particular a smaller part, of the light is deflected in the direction of the sensor.

In an advantageous manner, the light deflection device has an in particular rod-type extension that extends in the direction of the sensor. In this respect, the extension acts as an optical waveguide with a light exit area facing the sensor.

According to a further concept of the invention, the LED defines an installation plane, a main emission direction of the light pointing away from the installation plane, and the sensor being arranged on the opposite side of the installation plane with respect to the main emission direction of the light. The sensor can be positioned in a manner protected by this arrangement, even with regard to the evolution of heat by the LED and the light emitted overall by the LED. The main emission direction preferably extends perpendicular to the installation plane.

According to a further concept of the invention, the extension extends (counter to the main emission direction) to behind the installation plane. As a result, the light separated off for the sensor is reliably conducted as far as the sensor. It is also possible to shade the sensor with respect to the light emitted overall. In an advantageous manner, the extension extends as far as the sensor. Light losses are thereby minimized.

According to a further concept of the invention, the light deflection device is arranged in front of a wall, the extension extending through a cutout in the wall. The wall is opaque to the light and shades the sensor from the light emitted overall by the LED. The wall may be part of a housing of the luminaire.

The method according to the invention for operating the luminaire is characterized by the following features:

a) after the luminaire has been switched on, a specific LED current flows,
b) the light intensity of the LED is checked,
c) in the case of a light intensity below a reference value, the LED current is raised by a defined value,
d) steps b) and c) are repeated until the light intensity lies above the reference value.

The steps are carried out in the control unit. The latter is provided with a corresponding logic.

According to a further concept of the invention, the following method steps are provided:

a) each time the LED current is raised, a check is made to ascertain whether an upper limit value of the LED current is reached,
b) if the upper limit value has been reached, the LED current is not raised any further, not even when the light intensity decreases.

The aim is to avoid additional damage within the luminaire or at the connected current source.

According to a further concept of the invention, the following method steps are provided:

a) after the upper limit value has been reached, the operating hours (switch-on time) of the luminaire are counted,
b) after a defined number of operating hours has been reached, the switch-on function of the luminaire is blocked.

In this case, the LED remains dark despite the luminaire being switched on. However, the LED is preferably not switched off during operation in progress after the defined number of operating hours has been reached.

Further features of the invention emerge from the claims and from the rest of the description.

BRIEF DESCRIPTION OF THE DRAWINGS

Advantageous exemplary embodiments of the invention are explained in more detail below with reference to drawings, in which.

DETAILED DESCRIPTION OF THE PREFERRED EMBODIMENTS

Figure 2:
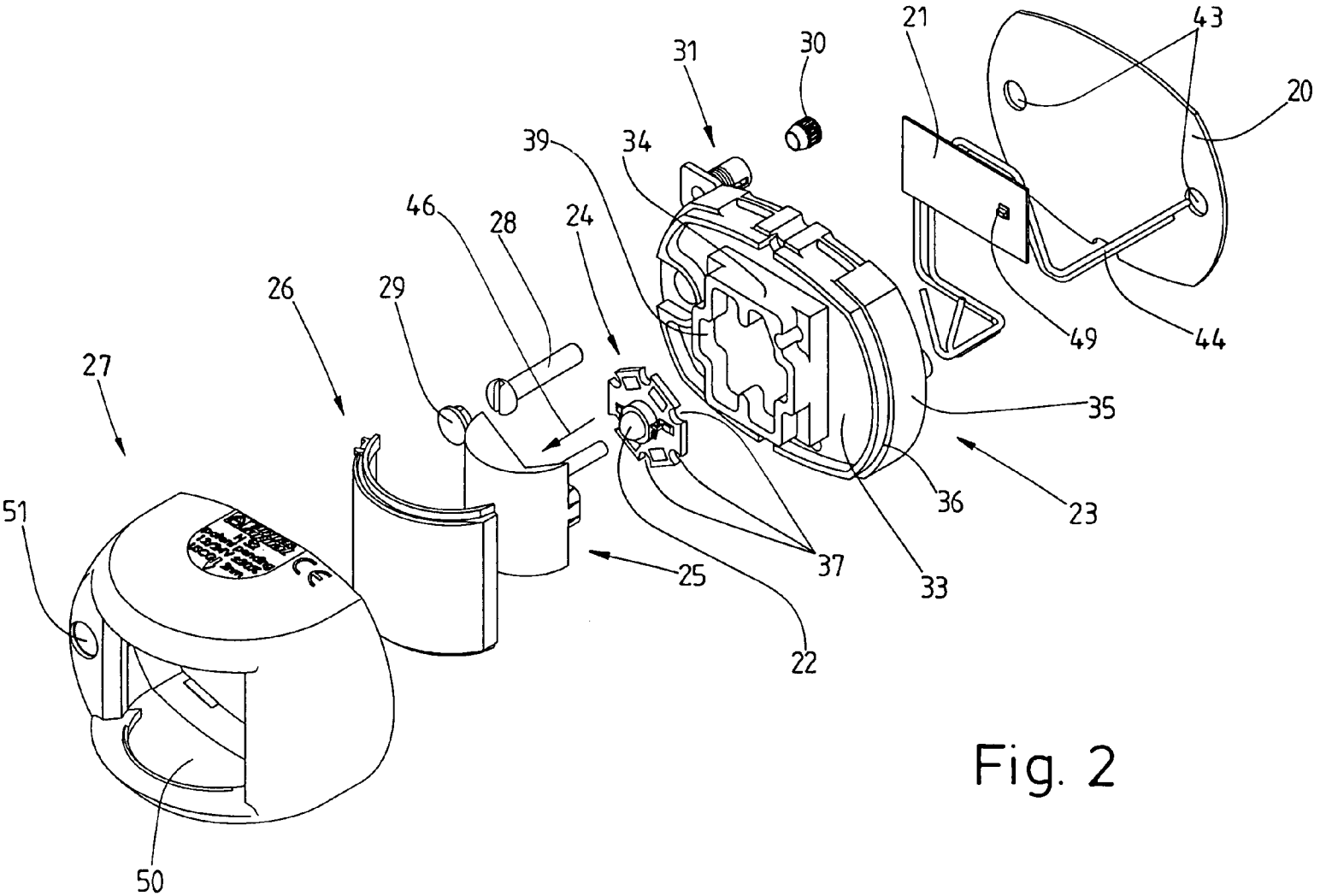
FIG. 2 shows an exploded illustration of a luminaire with LED according to the invention, namely a stern luminaire as navigation luminaire on ships.
Figure 3:
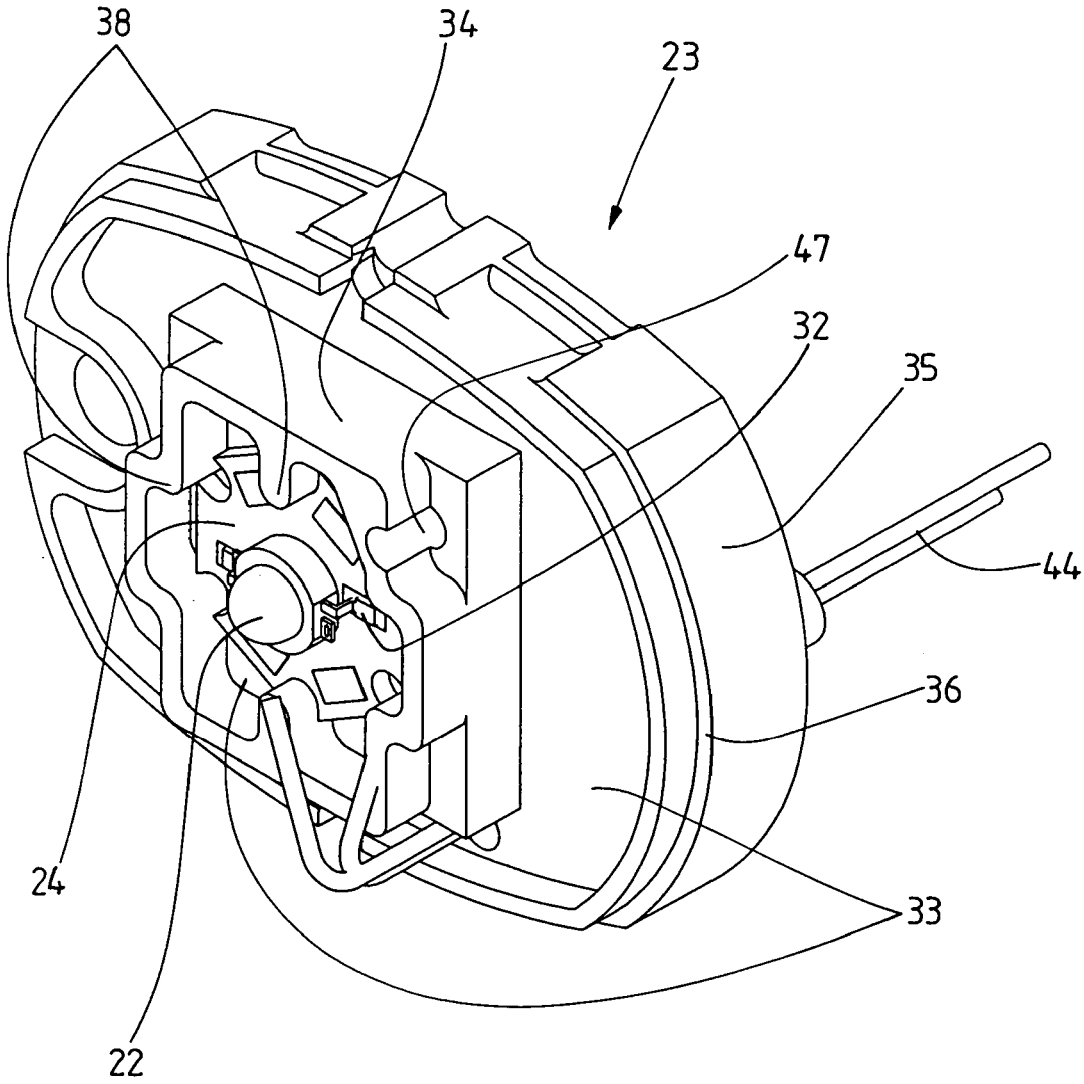
FIG. 3 shows a housing part with LED on a small circuit board in a perspective illustration.
Figure 4:
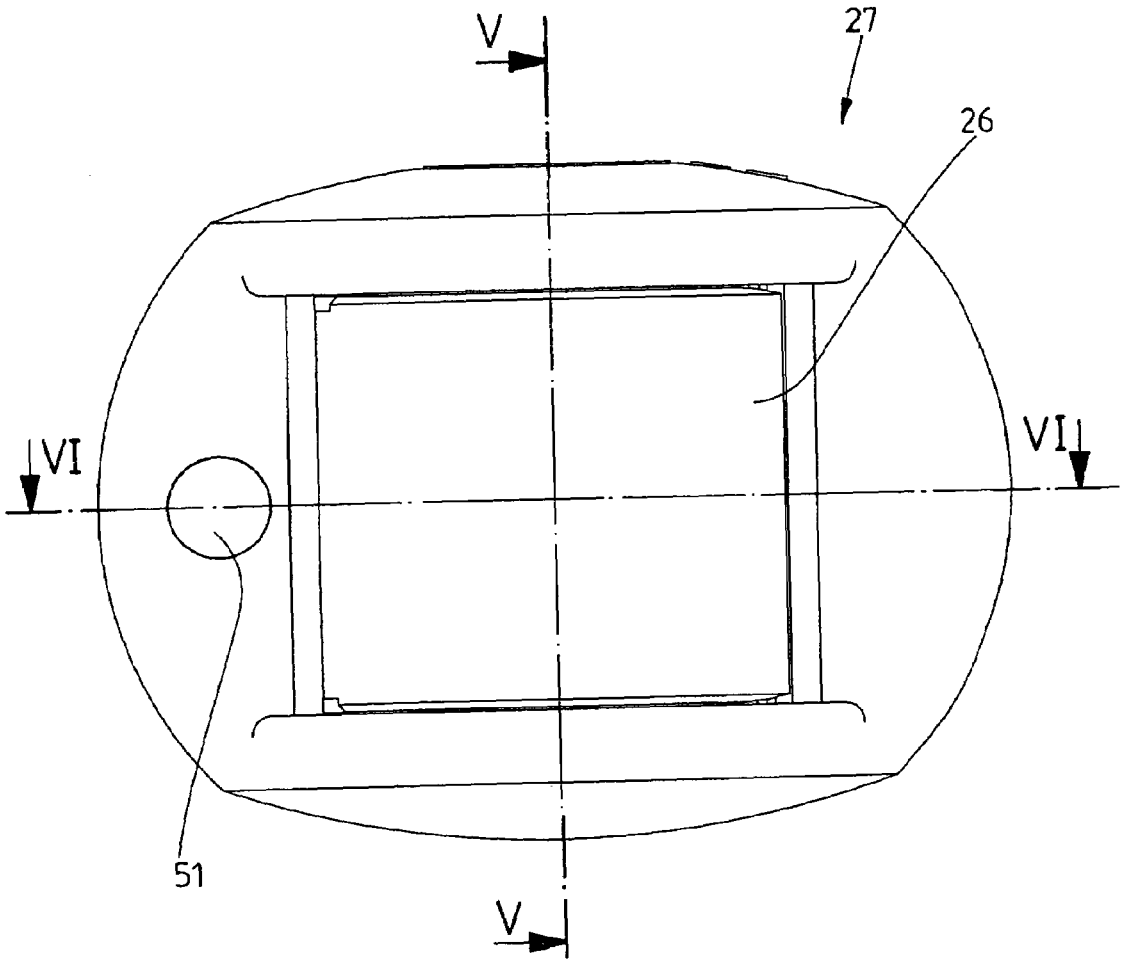
FIG. 4 shows a rearward (relative to the direction of travel of the ship) plan view of the stern luminaire.
Figure 5:
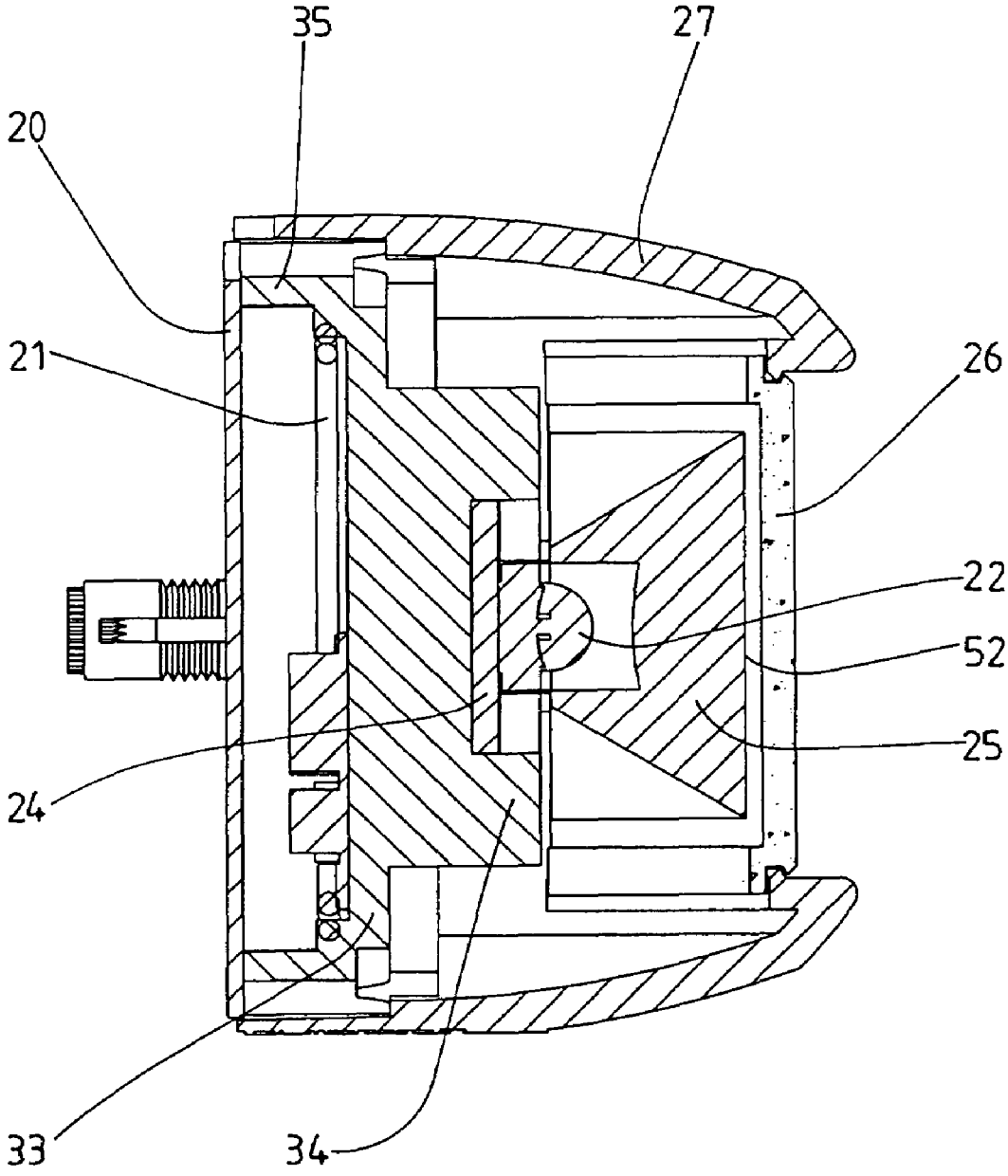
FIG. 5 shows a section through the stern luminaire along the line V-V in FIG. 4.

A stern luminaire as navigation luminaire of a ship has the following parts in accordance with FIG. 2:

A rear wall 20, a circuit board 21 with electrical and electronic components and circuits for driving an LED 22, a housing part 23 preferably made of aluminum, a small circuit board 24 with the LED 22 held centrally, a lens 25, a light-transmissive covering 26, a housing covering 27 and suitable fixing means, here a screw 28 with head covering 29, nut 30 and spreading sleeve 31.

The luminaire according to the invention constitutes a further development of the luminaires shown in EP 1 470 999 A2. There is correspondence with regard to the configuration of the lens 25 as far as the deflection of the externally visible emitted light is concerned. Significant deviations according to the invention in the construction of the lens 25 in relation to the representation in the aforementioned European patent application are explained in more detail further below. The light is emitted through the lens, in accordance with the legal regulations, essentially only via a laterally delimited sector of a horizontal plane.

The LED 22 is arranged fixedly on the small circuit board 24. The latter has contacts 32 for the connection of electrical lines (not shown).

The housing part 23 essentially comprises a central housing wall 33, on which is formed a connecting link 34 for receiving the small circuit board 24. Furthermore, the housing wall 33 is provided with a peripheral side wall 35. The latter has on the exterior a shoulder 36 for bearing a corresponding area (not shown) of the housing covering 27.

The small circuit board 24 has a peripheral edge with cutouts 37 into which corresponding projections 38 of the connecting link 34 enter. Moreover, the cutouts 37 and projections 38 are arranged and designed such that the small circuit board 24 can be inserted into the connecting link 34 only in a defined position.

When the small circuit board 24 has been inserted into the connecting link 34, this and the LED 22 bear as closely as possible on the housing wall 33. The heat that arises is thus effectively dissipated or distributed over the housing part 23 altogether.

The essentially annular connecting link 34 is at the same time provided with cutouts 39 on the inside, corresponding projections 40 of the lens 25 being held in said cutouts. Further parts of the lens 25 rest on the exterior of the connecting link 34 (apart from an exception mentioned further below). Consequently, the lens 25 also has a precisely defined relative position with respect to the connecting link 34 and thus with respect to the housing part 23.

The circuit board 21 is arranged in a manner resting on the rear side 41 of the housing wall 33, said rear side being remote from the connecting link 34, and may be held there for example by means of an adhesive-bonding connection. An internal space 42 is formed between the rear side 41 and the rear wall 20 and serves for receiving the components arranged on the circuit board 21. The rear wall 20 has two cutouts 43, namely for insertion of the spreading sleeve 31 and for the passage of electrical connecting lines 44.

An essential special feature is a pin-type extension 45 on the lens 25, to be precise essentially parallel to the projections 40. The extension 45 is arranged at the edge, in particular at the corner, on the lens 25 and extends counter to a main emission direction—arrow 46—of the LED 22.

The housing wall 33 has a cutout or hole for the extension 45, to be precise outside the connecting link 34. As a result, the light from the LED 22 does not pass directly to the extension 45. However, the extension 45 receives light only via its contact with the rest of the lens 25 or else part of the lens 25. On account of the length of the extension 45, a light exit area 48 at the end thereof lies in the region of the rear side 41 of the housing wall 33.

The circuit board 21 is provided with a light-sensitive sensor 49, which is arranged in direct proximity to the light exit area 48 and can be used to measure the light intensity of the LED 22 indirectly, namely via the lens 25 and the extension 45. Furthermore, the circuit board 21 has a programmable control unit (not specifically shown) formed from electronic components which serves for driving the LED.

Figure 6:
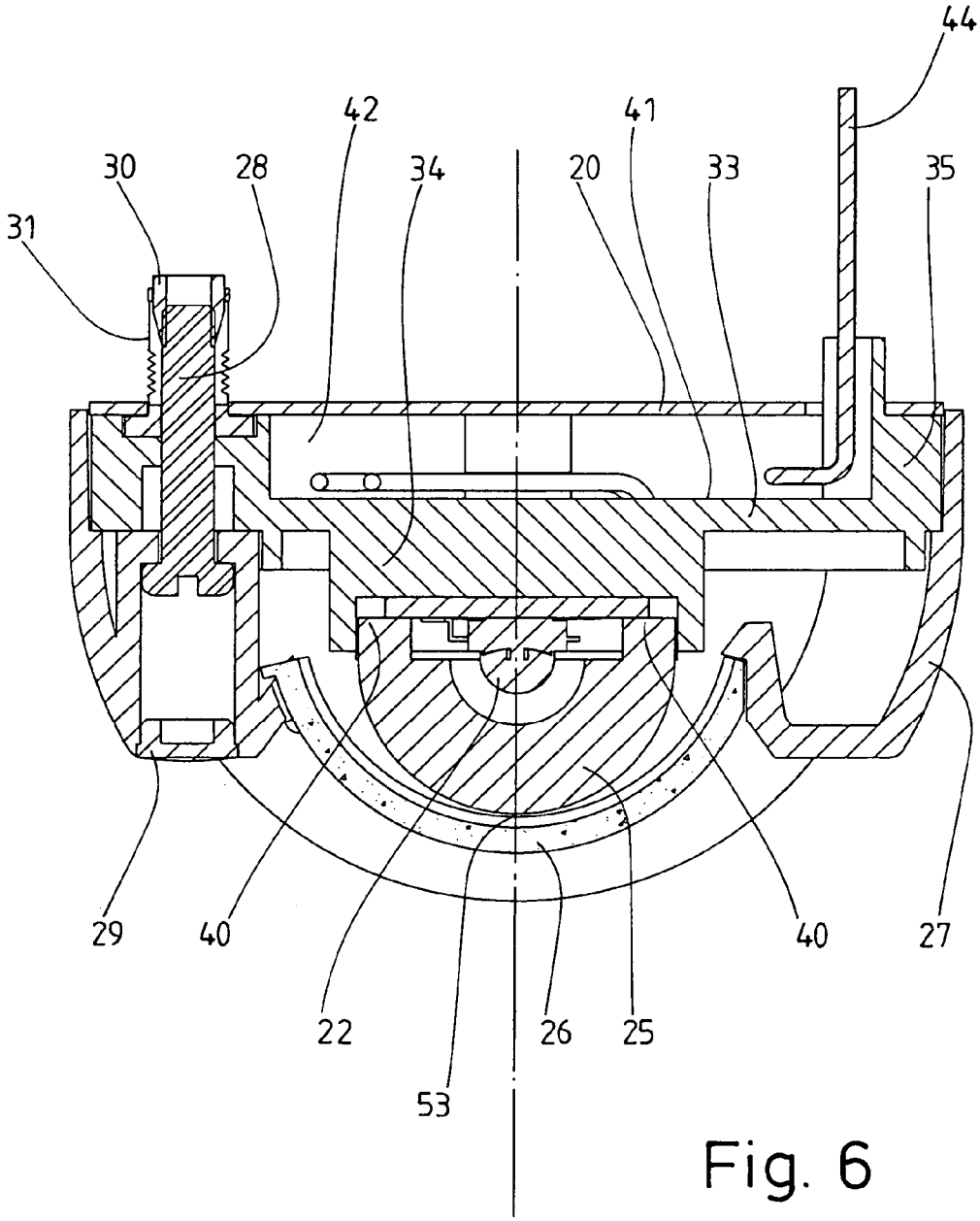
FIG. 6 shows a section through the stern luminaire in accordance with FIG. 4 along the line VI-VI.
Figure 7:
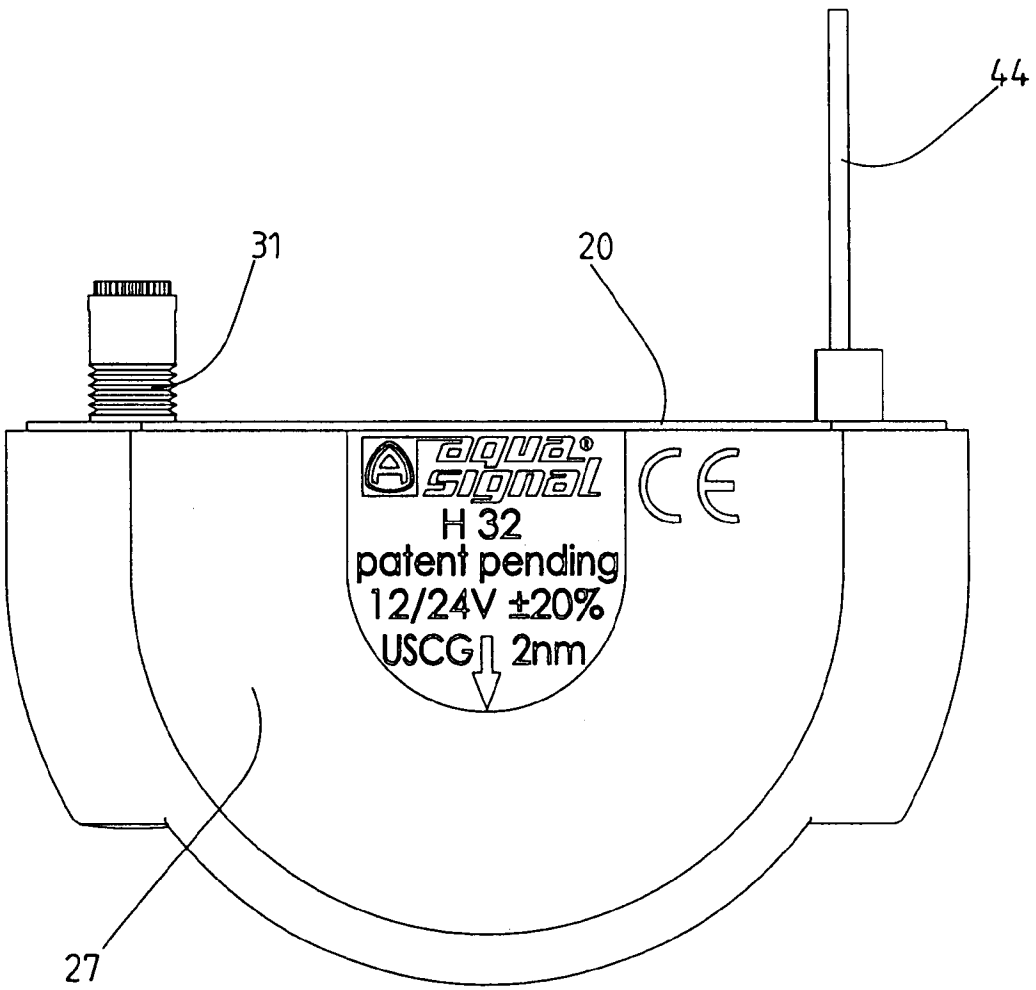
FIG. 7 shows a plan view of the stern luminaire.
Figure 8:
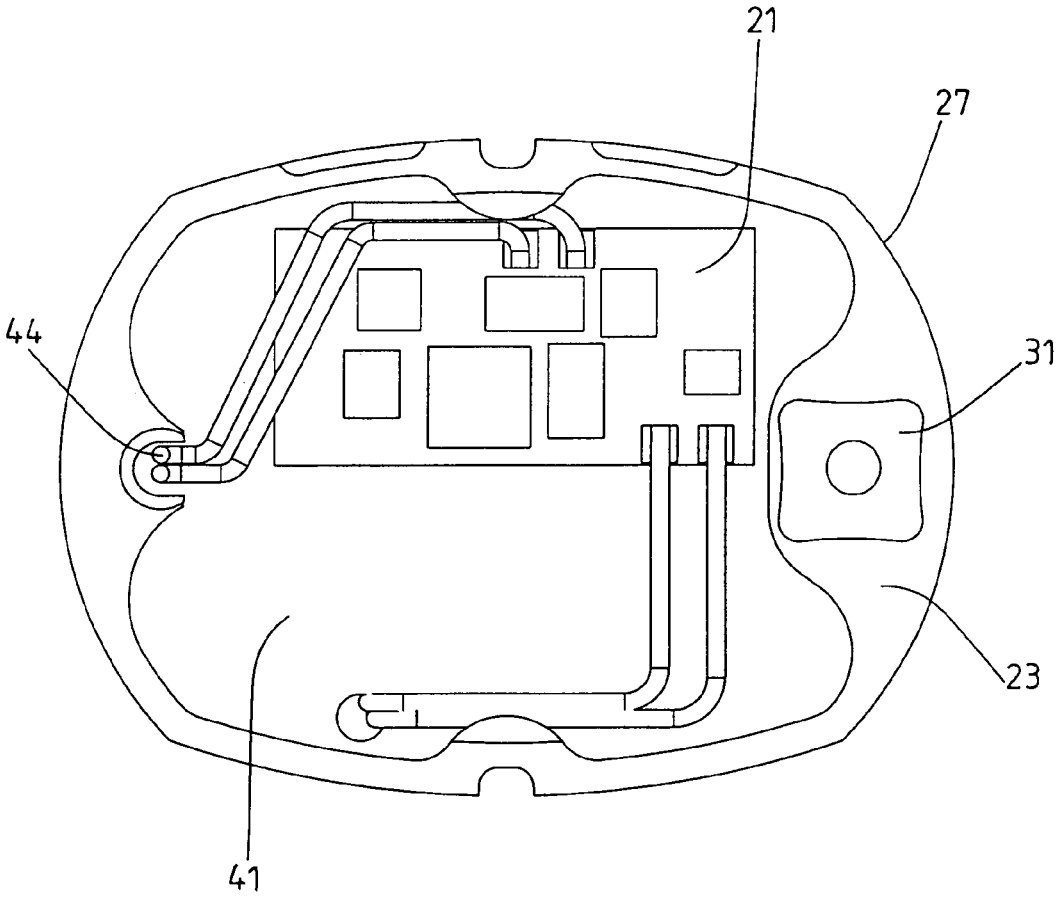
FIG. 8 shows a plan view of a rear side of the stern luminaire without a rear wall (front side or front wall as seen in the main direction of travel of the ship)
Figure 9:
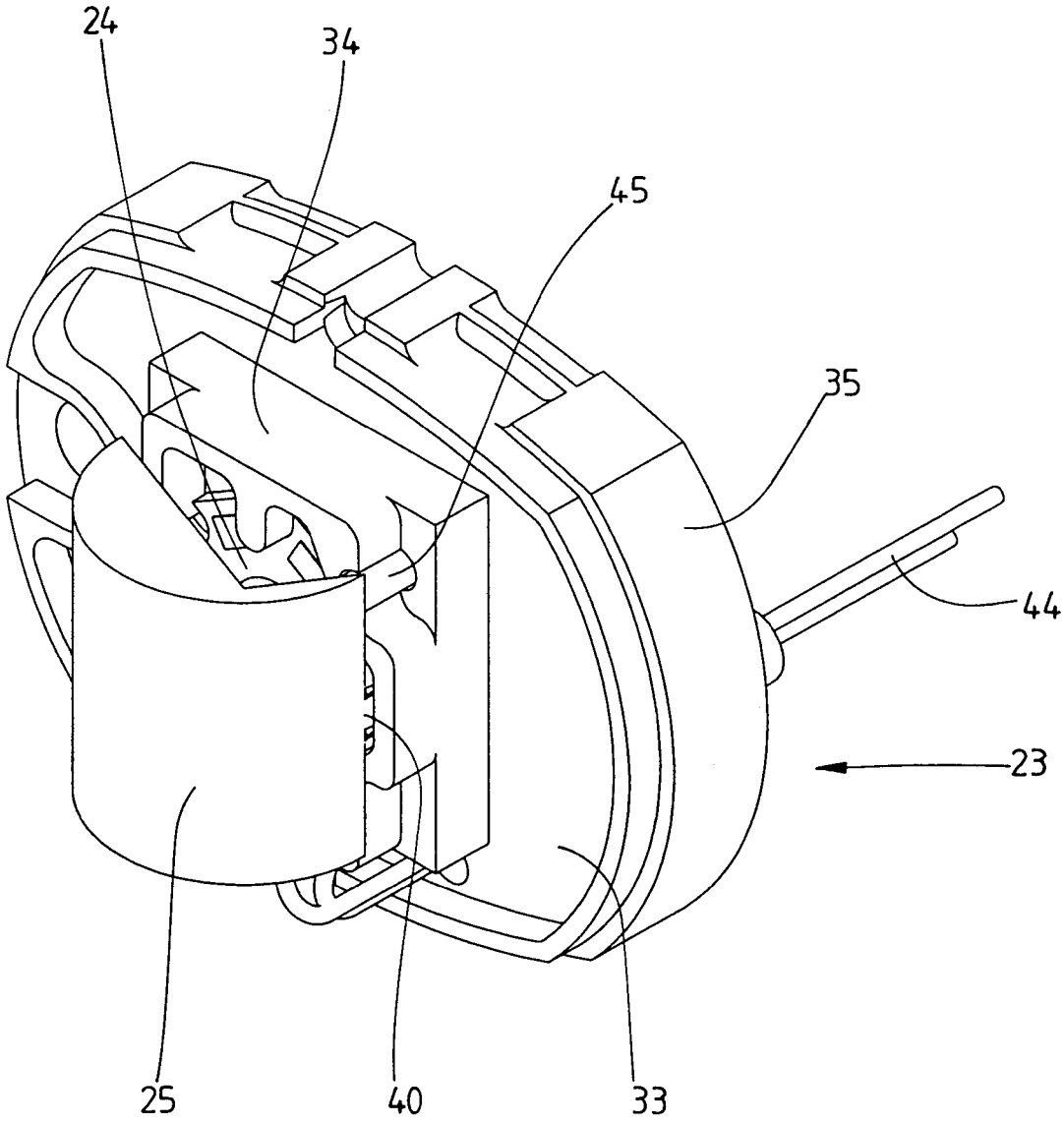
FIG. 9 shows a perspective illustration of the internals of the stern luminaire, namely a housing part with connecting link for receiving an LED and for bearing a lens.
Figure 10:
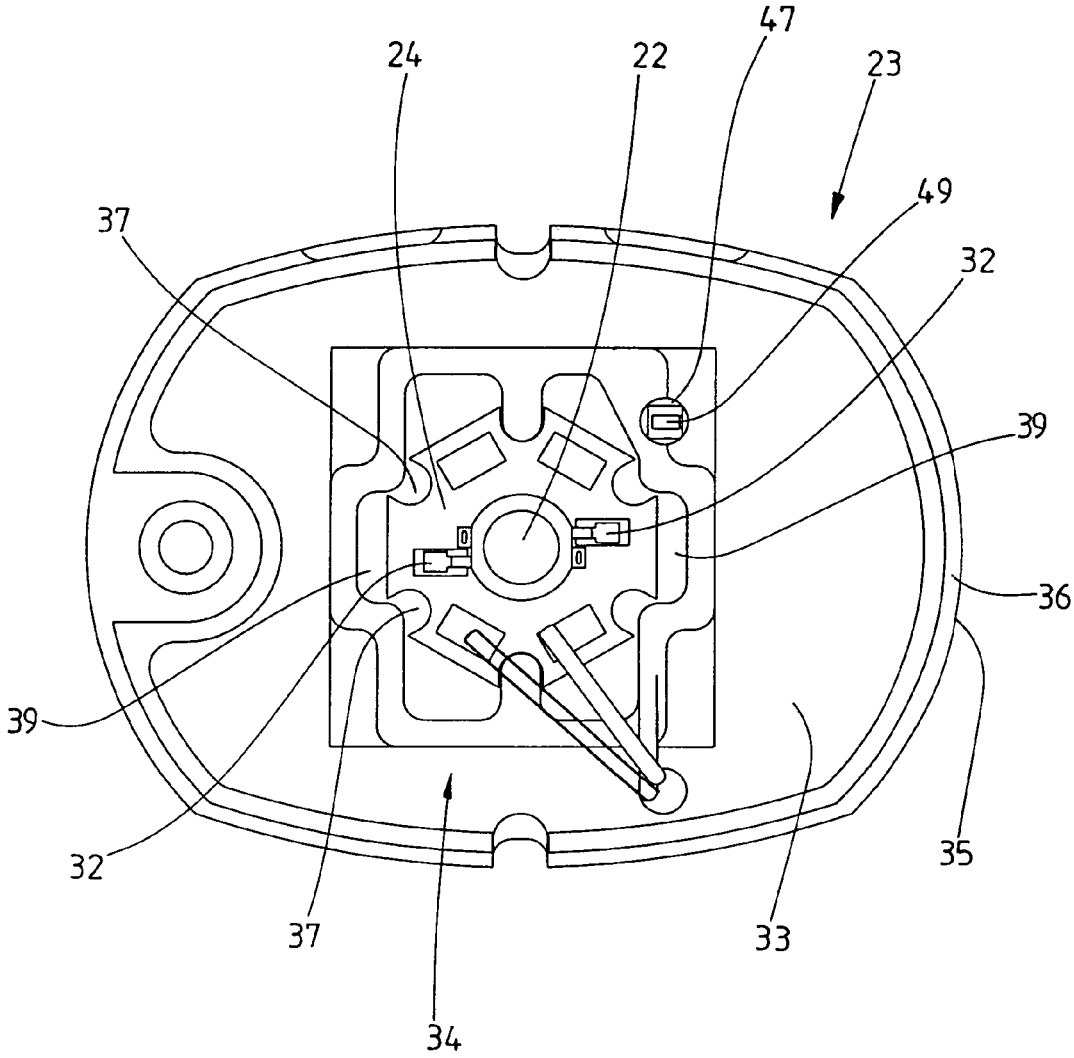
FIG. 10 shows a plan view of the components corresponding to FIG. 9, but without a lens.

The housing covering 27 has a window 50, into which the light-transmissive covering 26 is inserted from the inside. Directly beside the window 50, the housing covering 27 has a cutout, namely a hole 51 for passage of the screw 28. The light-transmissive covering 26 lies over a partly cylindrically curved outer light exit area 52 of the lens 25, to be precise at a small distance in the region of a vertex 53 and at larger distances laterally alongside the latter, see FIG. 6 in particular.

Figure 11:
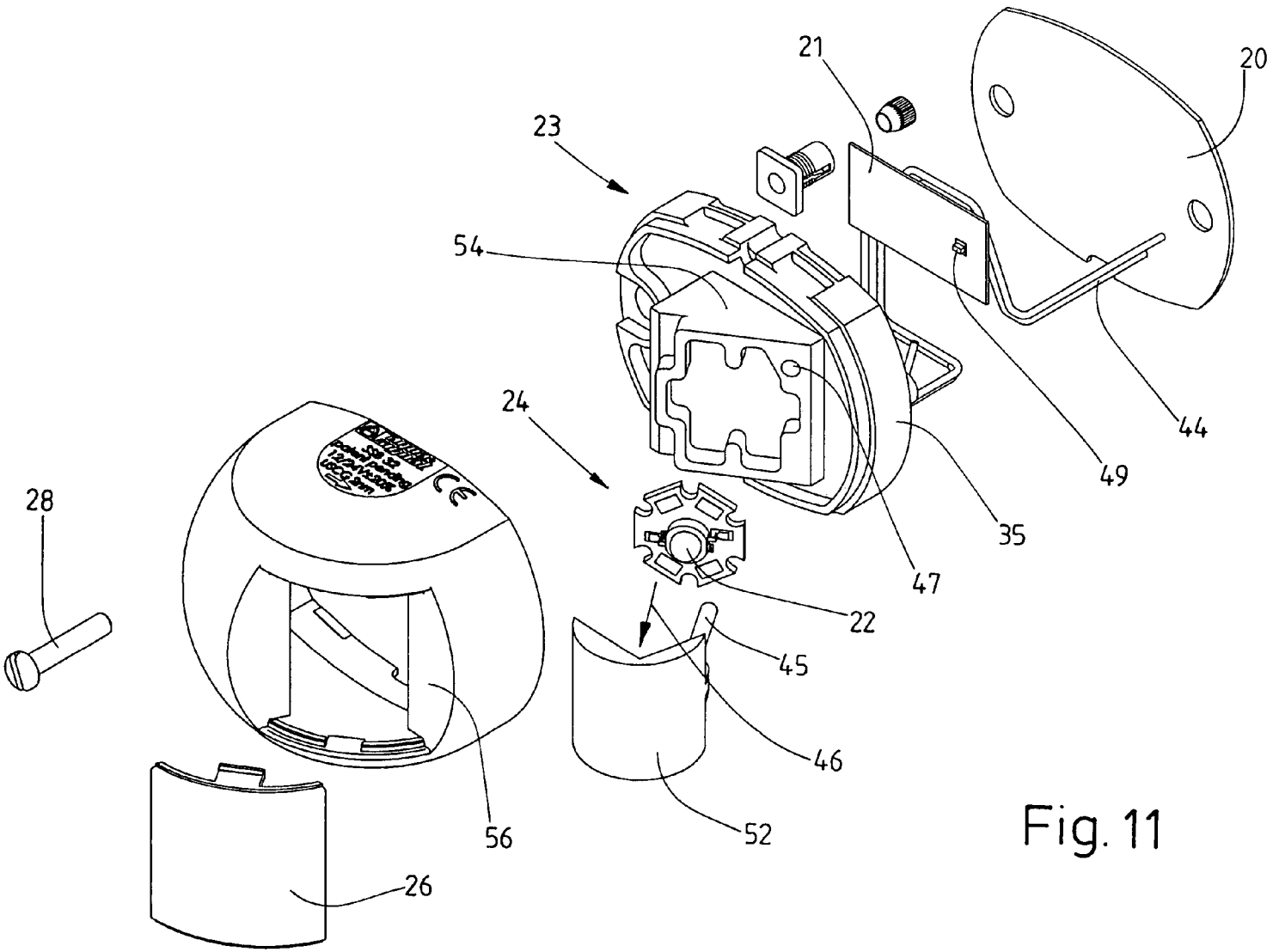
FIG. 11 shows an exploded illustration of the constituent parts of a navigation luminaire according to the invention for the starboard side of a ship analogously to the stern luminaire corresponding to FIG. 2.
Figure 12:
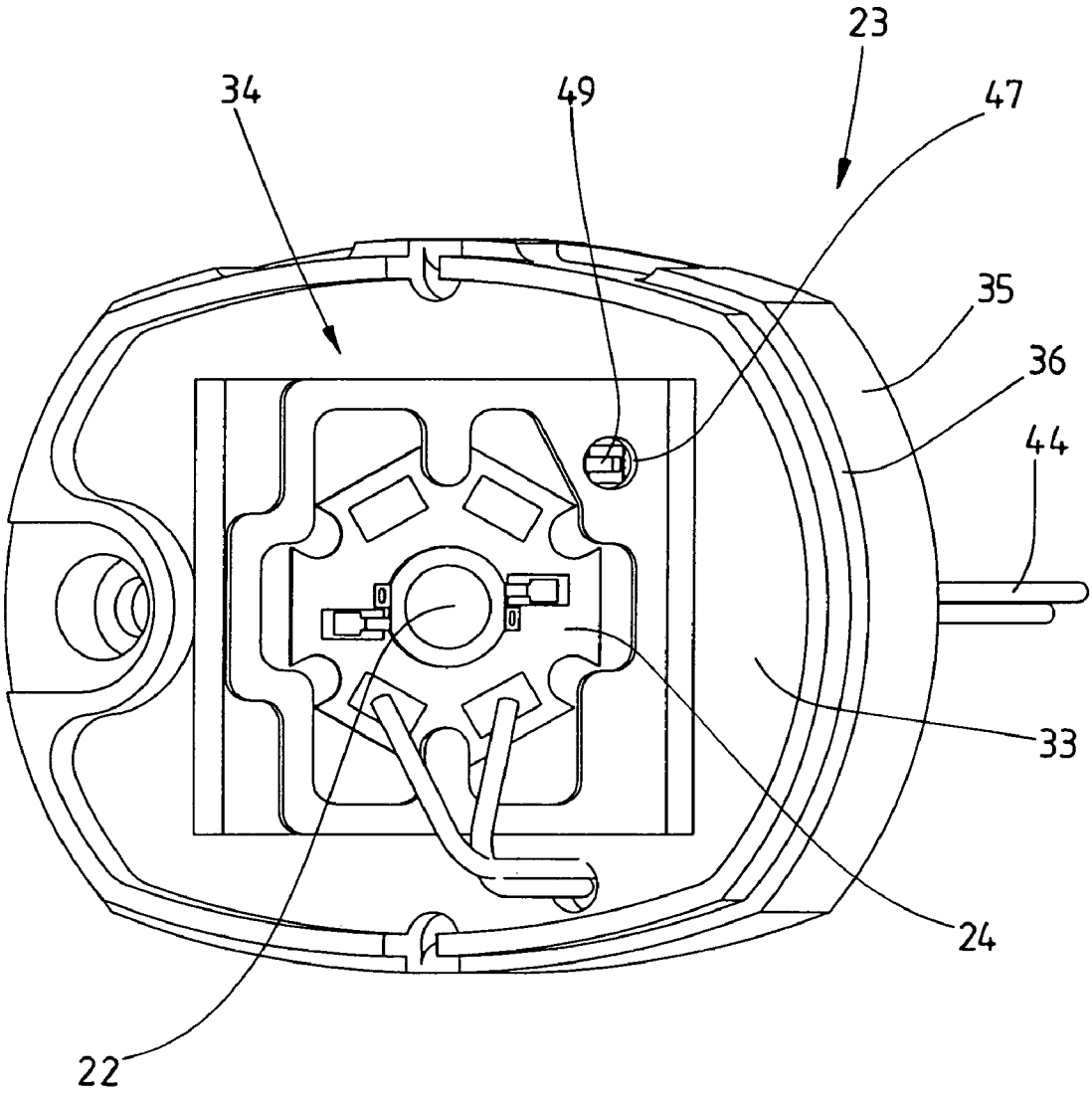
FIG. 12 shows a view of the starboard luminaire analogously to FIG. 10, but from a somewhat different viewing angle.
Figure 13:
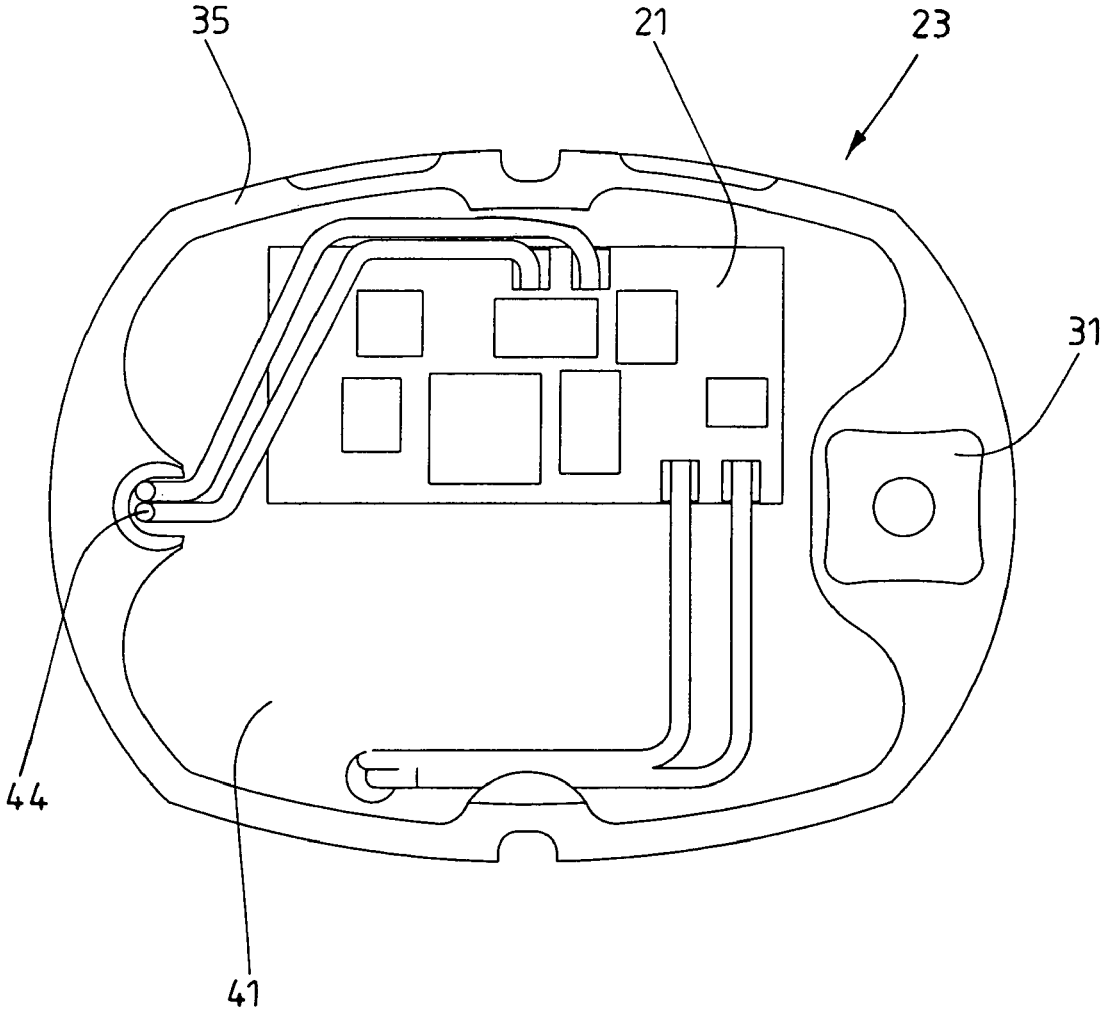
FIG. 13 shows a view of the rear side of the starboard luminaire in accordance with FIG. 10 and analogously to FIG. 8.

The starboard luminaire in accordance with FIGS. 11, 12, 13 and also the port luminaire are constructed in an analogous manner. Angular connecting links 54 are provided in order to represent an obliquely lateral light emission. Moreover, the housing coverings 27 are provided with laterally offset windows 56.

In the embodiment shown here, the luminaire has precisely one LED. The latter receives an LED current of approximately 200 mA at the beginning of its service life. The LED is maximally loaded with 350 mA.

For the stern luminaire, use is made of a light-intense white LED, in particular an LED from the manufacturer LUMILEDS Lighting LLC, San Jose, Calif., USA, preferably of the type LXHL-PD01 luxeon emitter (hemispherical dome). Of course, it is also possible to use LEDs from other manufacturers with similar specifications. The current values mentioned relate to the white LED. A green LED is used in the starboard luminaire and a red LED in the port luminaire. The colored LEDs have in some instances a higher luminous efficiency than white LEDs. The electrical values must be adapted correspondingly.

Figure 1:
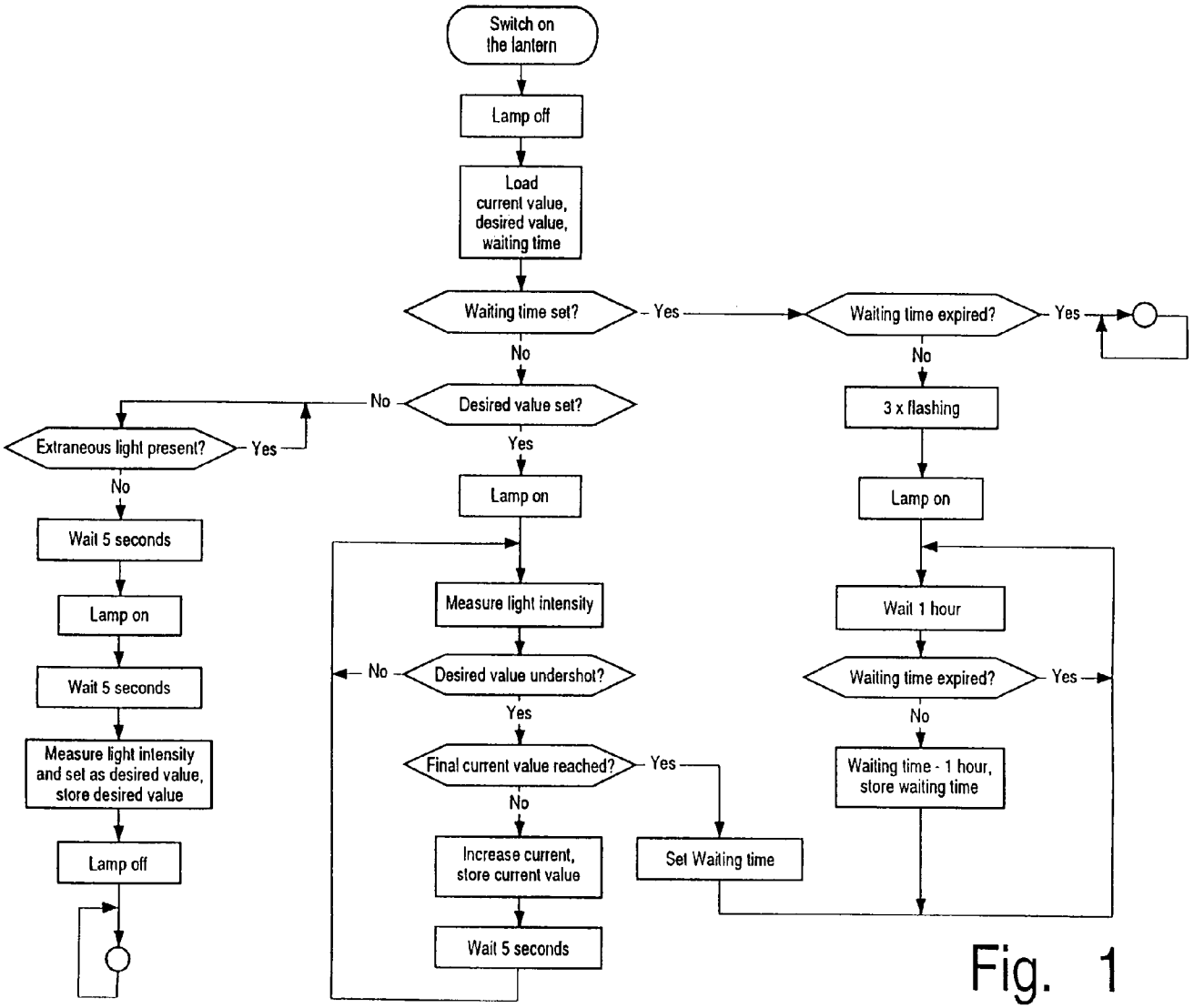
FIG. 1 shows a flowchart for illustrating the control of a luminaire with LED.

The operation of the luminaire and the function of the circuit are explained with reference to the flowchart in FIG. 1. A distinction is to be made between the first time that the luminaire is switched on, normal operation, the waiting mode, the defect mode.

Switching on for the First Time

The luminaire (lantern) is switched on for the first time in dark surroundings, so that the sensor 49 does not receive any light, preferably in the factory after production of the luminaire.

The luminaire is switched on. The LED remains off, however. Firstly, the sensor checks the presence of light. If light is detected, the LED continues to remain off. If the sensor 49 signals surroundings without light, the LED is switched on after a pause of 5 seconds. After a further 5 seconds, the light intensity measured by the sensor 49 is assumed as initial value and a light intensity that is up to 10% less than that is stored as desired value. The stored desired value is preferably 97% of the light intensity detected by the sensor. The desired value is also designated as reference value. Afterward, the LED automatically goes out or the luminaire is switched off manually.

Normal Operation

After the luminaire has been switched on in normal operation (middle branch of the flowchart in FIG. 1), the light intensity of the LED is measured. If the desired value (reference value) is undershot, the initial LED current is increased by a defined magnitude. The resultant LED current is stored as present current value. After a waiting time of 5 seconds, the light intensity is measured again by the sensor 49 and, if appropriate, the LED current is increased.

The light intensity of the LED decreases due to ageing. It is possible to maintain the light intensity by adapting the current value. In this case, the current value in the present example increases from initially 200 mA to a maximum of 350 mA. The increase is effected in discrete steps, preferably in 256 approximately identical steps.

Waiting Mode

After the maximum current value has been reached, a further increase in the current intensity is not recommendable. The thermal, mechanical and/or electrical safety of the luminaire might be jeopardized. Moreover, the luminaire is only operated for a specific time duration (waiting time) and can no longer be switched on after this has elapsed. The first time the desired light intensity is undershot with the maximum current value being present simultaneously, the waiting time begins; a waiting time flag is set. Starting from this point in time, the operating duration, in particular the operating hours of the LED, is counted and stored. After 200 hours have elapsed, the waiting time has elapsed and the LED is deemed to be defective.

Luminaires are usually switched on and off again dependent on daylight, so that a daily cycle is established with a cycle duration that is significantly shorter than the waiting time. As a result, enough time remains for the maintenance personnel to implement measures for exchanging the luminaire or just the LED.

In order to facilitate such measures, when the luminaire is switched on, firstly a check is made to ascertain whether the waiting time flag is set. If this is the case, the LED briefly flashes a number of times, in particular three times, upon switch-on and then lights up without any further interruption. The flashing LED makes the maintenance personnel aware of the imminent failure of the LED.

Defect Mode

After the waiting time has elapsed, the LED is deemed to be defective, although generally only light with a reduced light intensity is emitted. In the defect mode, the LED is no longer switched on. Correspondingly, when the luminaire is switched on, a check is made to ascertain whether the waiting time has elapsed. If so, the LED remains dark. In order to avoid a failure of the luminaire in darkness, the LED is not automatically switched off during operation in progress. It is only prevented from being switched on again after the waiting time has elapsed.

The signaling of a specific operating state of the LED depending on the light intensity and/or the LED current may be effected when the luminaire is switched on or off, in particular by means of a brief flashing mode of the LED.

The functions described for operation of the luminaire are realized in suitable electronic circuits (control unit) with corresponding software on the circuit board 21. With knowledge of the functions described, the construction of such a circuit is possible for a person skilled in the art of electronics, even without effecting an inventive step in this case.

List of Reference Symbols:

| | |
|---|---|
| 20 | Rear wall |
| 21 | Circuit board |
| 22 | LED |
| 23 | Housing part |
| 24 | Small circuit board |
| 25 | Lens |
| 26 | Light-transmissive Covering |
| 27 | Housing covering |
| 28 | Screw |
| 29 | Head covering |
| 30 | Nut |
| 31 | Spreading sleeve |
| 32 | Contacts |
| 33 | Housing wall |
| 34 | Connecting link |
| 35 | Peripheral side wall |
| 36 | Shoulder |
| 37 | Cutouts |
| 38 | Projections |
| 39 | Cutouts |
| 40 | Projections |
| 41 | Rear side |
| 42 | Internal space |
| 43 | Cutouts |
| 44 | Lines |
| 45 | Extension |
| 46 | Arrow |
| 47 | Cutout |
| 48 | Light exit area |
| 49 | Sensor |
| 50 | Window |
| 51 | Hole |
| 52 | Light exit area |
| 53 | Vertex |
| 54 | Connecting link |
| 56 | Window |

The invention claimed is:

1. A luminaire with at least one LED as luminous means, comprising:

a) a sensor (49) for detecting at least a part of the light emitted by the at least one LED (22), b) a control unit for evaluating the detected signals from the sensor and for influencing the at least one LED (22) in a manner dependent on the sensor detected signals, wherein the control unit regulates an electric current of the at least one LED (LED current) in a manner dependent on the sensor detected signals such that a light intensity of the at least one LED (22) remains greater than a reference value wherein the reference value of a desired light intensity of the at least one LED is defined by the control unit as follows:

a) after the luminaire has been switched on for a first time, the desired value of the light intensity is determined as the reference value in a manner dependent on the sensor detected signals then present, b) the reference value is stored by the control unit.

2. The luminaire as claimed in claim 1, wherein the control unit prescribes a defined LED current when the luminaire is switched on for a first time.

3. The luminaire as claimed in claim 1, wherein the control unit permanently or cyclically compares the sensor detected signals with the reference value and, in the event of the reference value being undershot, raises the LED current by a defined step from a present current value to a new current value, and stores the new current value as present current value.

4. The luminaire as claimed in claim 3, wherein, when the luminaire is switched on again, the control unit prescribes the present current value that was stored last as LED current.

5. The luminaire as claimed in claim 3, wherein the control unit raises the current value only up to a defined maximum value.

6. The luminaire as claimed in claim 5, wherein after reaching the maximum value, the control unit concomitantly counts and stores operating hours of the at least one LED (22).

7. The luminaire as claimed in claim 6, wherein the control unit blocks a switching-on of the at least one LED as soon as a defined number of operating hours (after reaching the maximum value) has been reached.

8. The luminaire as claimed in claim 1, wherein the control unit switches off the at least one LED (22) after a defined light intensity is undershot.

9. A luminaire with at least one LED as luminous means, comprising:

a) a sensor (49) for detecting at least a part of the light emitted by the at least one LED (22);

b) a control unit for evaluating the sensor detected signals from the sensor and for influencing the at least one LED (22) in a manner dependent on the sensor detected signals; and c) a light deflection device, wherein the light deflection device deflects the light such that one part of the light is emitted by the luminaire and another part of the light is deflected to the sensor (49), and the light deflection device has a rod-type extension (45) that extends towards the sensor (49).

10. The luminaire as claimed in claim 9, wherein the at least one LED (22) defines an installation plane, a main emission direction (46) of the light pointing away from the installation plane, and the sensor (49) being arranged on the opposite side of the installation plane with respect to the main emission direction of the light.

11. The luminaire as claimed in claim 10, wherein the extension (45) extend, counter to the main emission direction (46), to behind the installation plane.

12. The luminaire as claimed in claim 9, wherein the extension (45) extends as far as the sensor (49).

13. The luminaire as claimed in claim 9, wherein the light deflection device is arranged in front of a wall (33), the extension (45) extending through a cutout in the wall.

14. A method for operating a luminaire having a sensor (49) for detecting at least a part of the light emitted by an LED (22) and a control unit for evaluating detected signals from the sensor and for influencing the LED (22) in a manner dependent on the sensor detected signals, comprising the steps of:

a) after the luminaire has been switched on, a specific LED current flows, b) a light intensity of the LED is checked, c) in the case of the light intensity below a reference value, the LED current is raised by a defined value, d) steps b) and c) are repeated until the light intensity is greater than the reference value.

15. The method as claimed in claim 14, further comprising the following steps:

a) each time the LED current is raised, a check is made to ascertain whether an upper limit value of the LED current is reached, and b) if the upper limit value has been reached, the LED current is not raised any further.

16. The method as claimed in claim 15, further comprising the following steps:

a) after the upper limit value has been reached, operating hours (switch-on time) of the luminaire are counted, b) after a defined number of the operating hours or time of operating hours has been reached, the switch-on function of the luminaire is blocked.

* * * * *